US011446808B1

(12) United States Patent
Alemayehu

(10) Patent No.: US 11,446,808 B1
(45) Date of Patent: Sep. 20, 2022

(54) TROWEL PROTECTOR ACCESSORY

(71) Applicant: Samson Alemayehu, Sagus, MA (US)

(72) Inventor: Samson Alemayehu, Sagus, MA (US)

( * ) Notice: Subject to any disclaimer, the term of this patent is extended or adjusted under 35 U.S.C. 154(b) by 626 days.

(21) Appl. No.: 16/459,729

(22) Filed: Jul. 2, 2019

(51) Int. Cl.

| | |
|---|---|
| ***B25H 3/00*** | (2006.01) |
| ***E04G 21/20*** | (2006.01) |
| ***E04F 21/06*** | (2006.01) |
| ***E04F 21/16*** | (2006.01) |

(52) U.S. Cl.
CPC ..... *B25H 3/006* (2013.01); *E04F 21/06* (2013.01); *E04F 21/161* (2013.01); *E04G 21/201* (2013.01)

(58) Field of Classification Search
CPC ..... B25H 3/006; E04F 21/06; E04F 21/161; E04G 21/201; B65D 81/053
USPC ..... 206/349, 453
See application file for complete search history.

(56) References Cited

U.S. PATENT DOCUMENTS

| | | | | |
|---|---|---|---|---|
| 2,952,028 | A | 9/1960 | Robbins | |
| D289,882 | S | 5/1987 | Gringer | |
| 6,491,162 | B2 | 12/2002 | Barham | |
| 7,017,739 | B2 | 3/2006 | Barham | |
| 8,960,429 | B1 | 2/2015 | Crockett | |
| 10,737,865 | B1 * | 8/2020 | Sooklaris | B65D 81/053 |
| 2003/0226776 | A1 * | 12/2003 | Stamm | B25H 3/006 206/349 |
| 2005/0133389 | A1 * | 6/2005 | Baublitz | B65D 75/22 206/349 |
| 2006/0032876 | A1 | 2/2006 | Goffinet | |
| 2007/0023471 | A1 | 2/2007 | Garcia | |
| 2012/0273376 | A1 * | 11/2012 | Nicholls | B65D 85/58 206/349 |
| 2015/0291311 | A1 * | 10/2015 | Meza Cabello | B65D 25/02 206/427 |

FOREIGN PATENT DOCUMENTS

| | | |
|---|---|---|
| WO | 02090000 | 11/2002 |

* cited by examiner

*Primary Examiner* — Rafael A Ortiz
*Assistant Examiner* — Sanjidul Islam
(74) *Attorney, Agent, or Firm* — Kyle A. Fletcher, Esq.

(57) ABSTRACT

The trowel protector accessory is configured for use with a trowel. The trowel protector accessory is a guard that attaches to the trowel. The trowel protector accessory encloses a plurality of lateral faces of the trowel. The trowel protector accessory prevents the edges of the trowel from causing inadvertent damage. The trowel is stored within the trowel protector accessory. The trowel is removed from the trowel when the trowel is in use. The trowel protector accessory comprises the trowel and the edge guard. The edge guard encloses the plurality of lateral faces of the trowel when the trowel is stored.

18 Claims, 6 Drawing Sheets

TROWEL PROTECTOR ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed construction and implements for finishing work on buildings, more specifically, a trowel for applying a plasticized mass to a surface. (E04F21/161)

SUMMARY OF INVENTION

The trowel protector accessory is configured for use with a trowel. The trowel protector accessory is a guard that attaches to the trowel. The trowel protector accessory encloses a plurality of lateral faces of the trowel. The trowel protector accessory prevents the edges of the trowel from causing inadvertent damage or for purposes of safety. The trowel is stored within the trowel protector accessory. The trowel is removed from the trowel when the trowel is in use. The trowel comprises a blade and a handle. The blade is a disk-shaped structure that is further defined with a working surface, a handle 112 surface, and a plurality of lateral faces. The working surface forms the working element of the blade. The handle 112 surface is the face of the blade that is distal from the working surface. The handle manipulates the trowel. The plurality of lateral faces attach the faces of the disk structure of the blade to each other. The trowel protector accessory comprises the trowel and the edge guard. The edge guard encloses the plurality of lateral faces of the trowel when the trowel is stored.

These together with additional objects, features and advantages of the trowel protector accessory will be readily apparent to those of ordinary skill in the art upon reading the following detailed description of the presently preferred, but nonetheless illustrative, embodiments when taken in conjunction with the accompanying drawings.

In this respect, before explaining the current embodiments of the trowel protector accessory in detail, it is to be understood that the trowel protector accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the trowel protector accessory.

It is therefore important that the claims be regarded as including such equivalent construction insofar as they do not depart from the spirit and scope of the trowel protector accessory. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
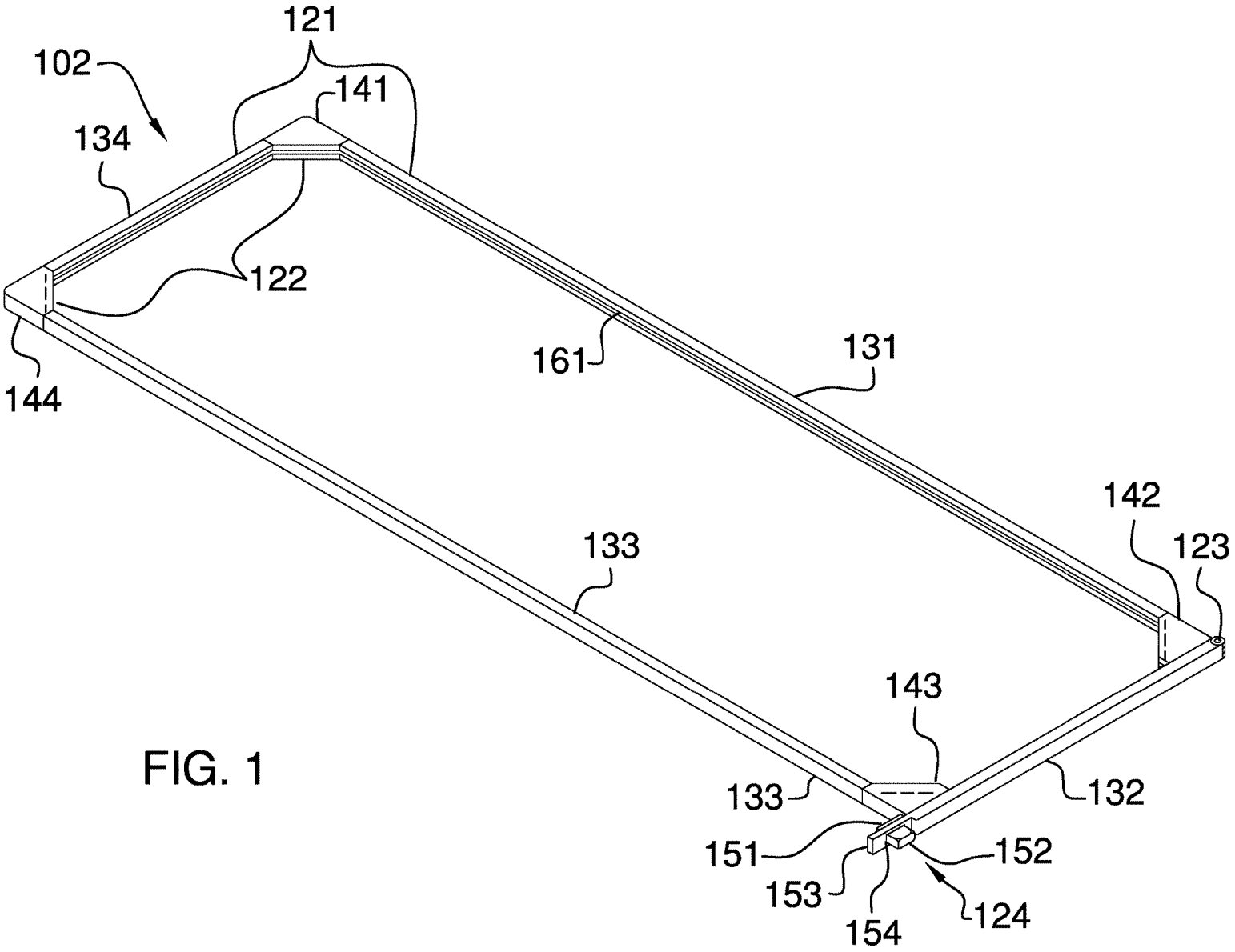
FIG. 1 is a perspective view of an embodiment of the disclosure.
Figure 2:
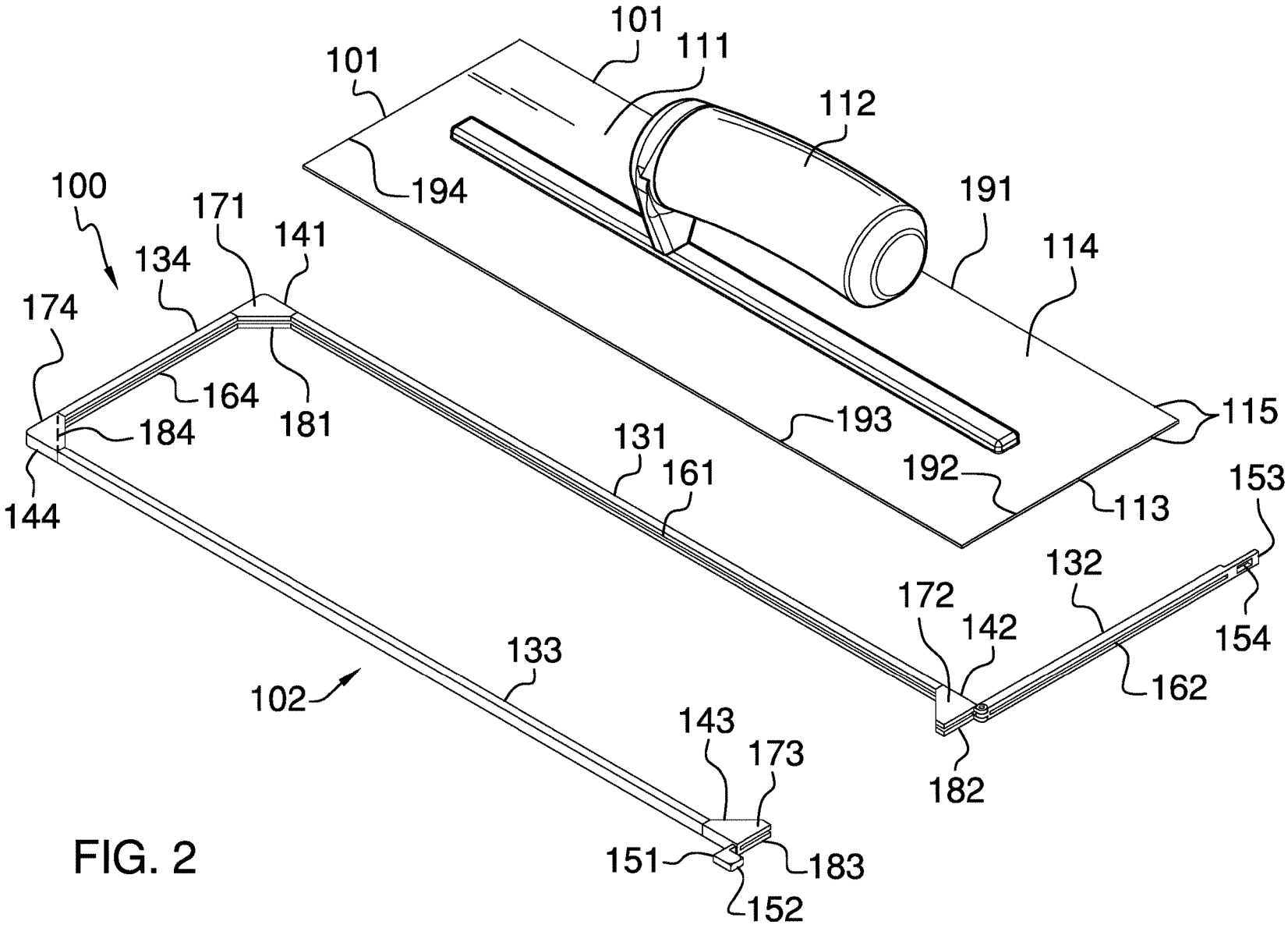
FIG. 2 is a perspective view of an embodiment of the disclosure.
Figure 3:
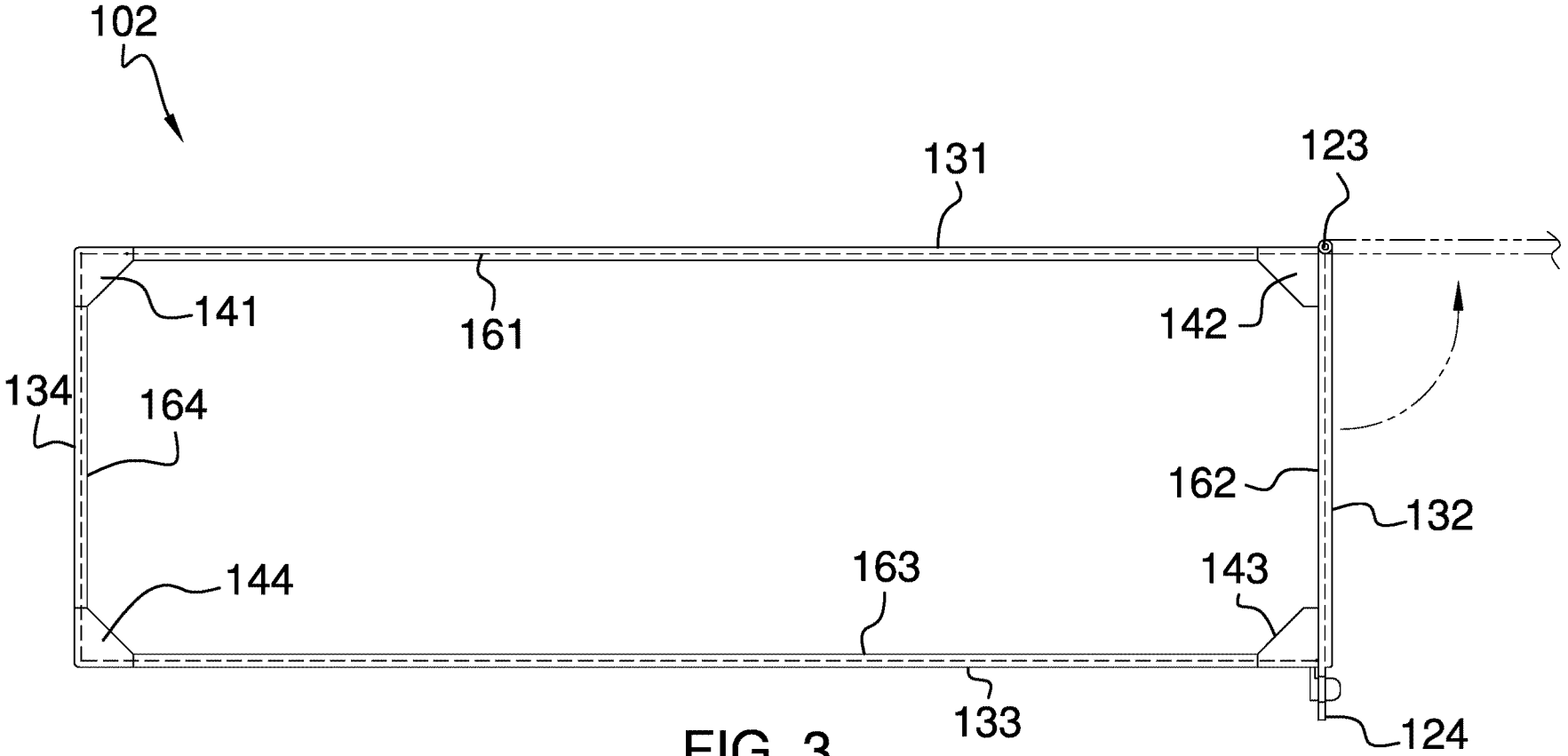
FIG. 3 is a top view of an embodiment of the disclosure.
Figure 4:
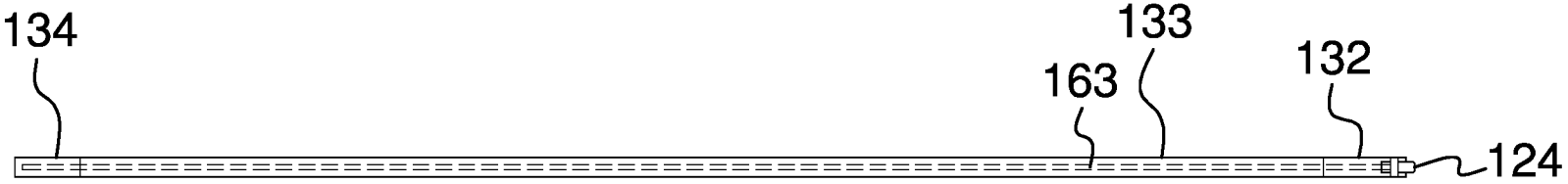
FIG. 4 is a side view of an embodiment of the disclosure.
Figure 5:
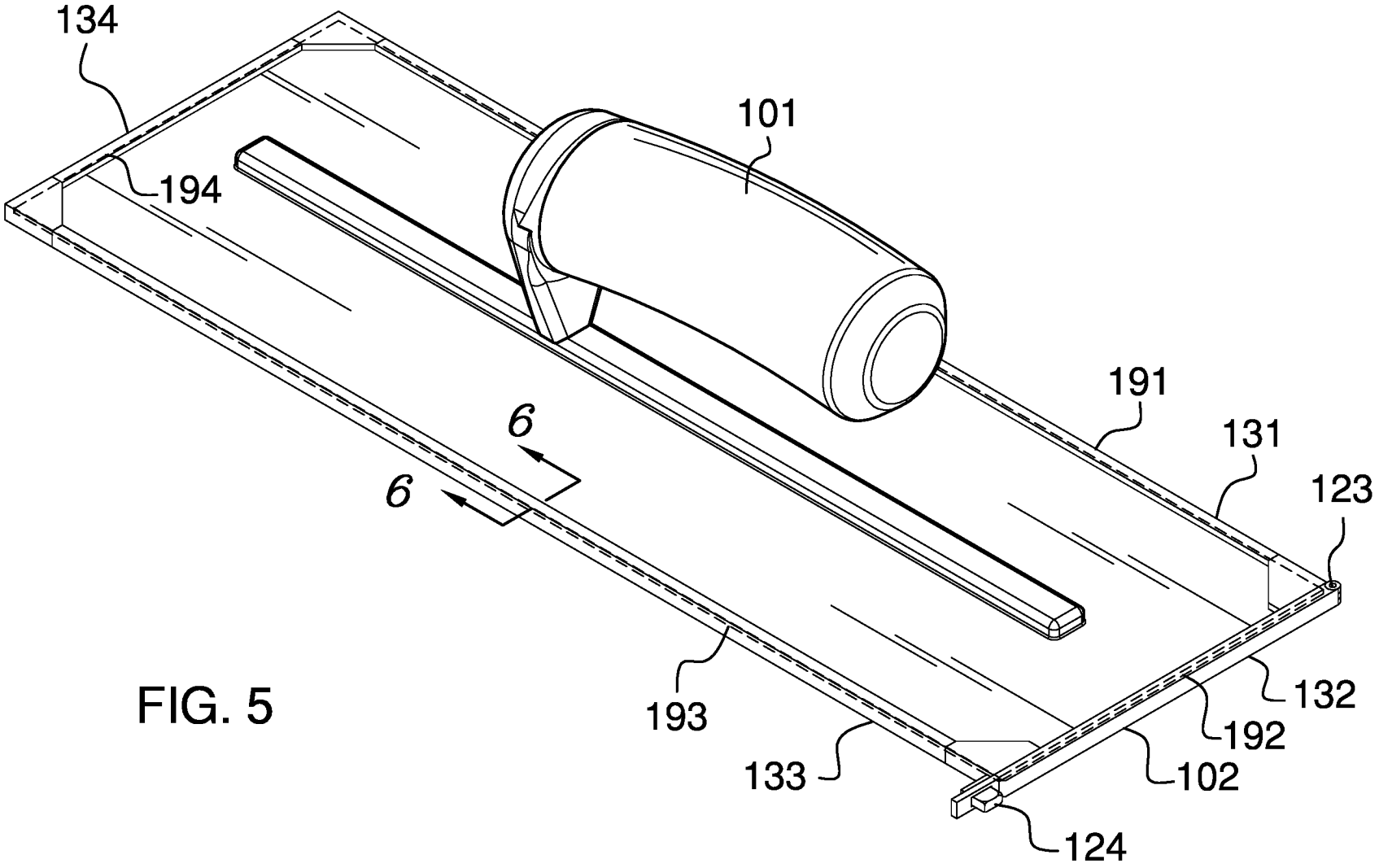
FIG. 5 is an in-use view of an embodiment of the disclosure.
Figure 6:
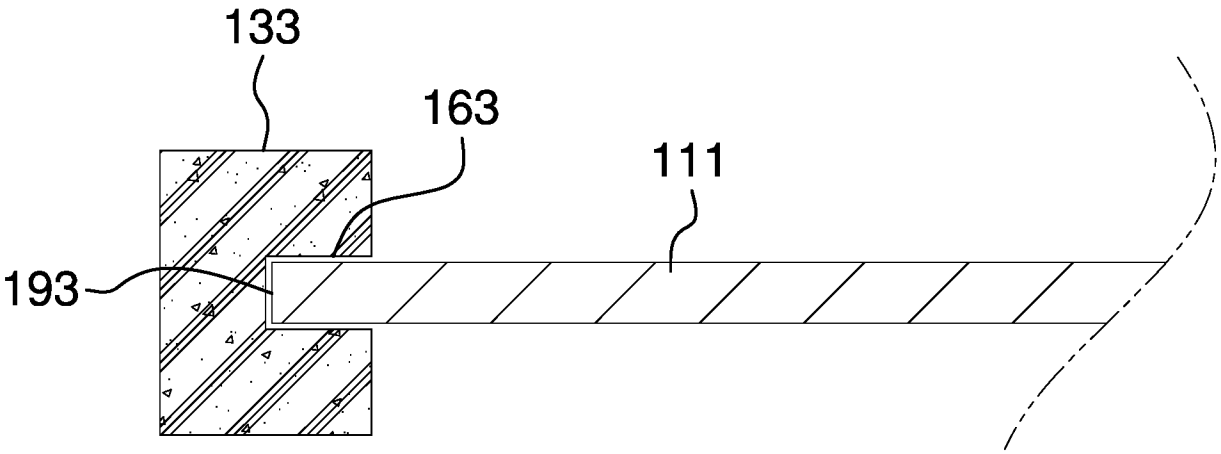
FIG. 6 is a cross-sectional view of an embodiment of the disclosure across 6-6 as shown in FIG. 5.

Detailed reference will now be made to one or more potential embodiments of the disclosure, which are illustrated in FIGS. 1 through 6.

The trowel protector accessory 100 (hereinafter invention) is configured for use with a trowel 101. The invention 100 is a guard that attaches to the trowel 101. The invention 100 encloses a plurality of lateral faces 115 of the trowel 101. The invention 100 prevents the edges of the trowel 101 from causing inadvertent damage. The invention 100 comprises the trowel 101 and the edge guard 102. The edge guard 102 encloses the plurality of lateral faces 115 of the trowel 101 when the trowel 101 is stored.

The trowel 101 is a hand tool. The trowel 101 is a bladed tool. The trowel 101 is configured for use in applying a coat of viscous material to a surface. The trowel 101 comprises a blade 111 and a handle 112. The blade 111 is a disk-shaped structure that is further defined with a working surface 113, a handle 112 surface 114, and a plurality of lateral faces 115.

The blade 111 is a disk-shaped structure. The blade 111 forms the working element of the trowel 101. The blade 111 is the element of the trowel 101 that is stored in the edge guard 102. The handle 112 is a grip. The handle 112 attaches to the blade 111 such that the handle 112 allows for the transport and manipulation of the trowel 101.

The working surface 113 is a face of the disk structure of the blade 111. The working surface 113 forms the surface that is used as the working element of the trowel 101. The handle 112 surface 114 is the face of the disk structure of the trowel 101 that is distal from the working surface 113. The handle 112 attaches to the handle 112 surface 114 of the trowel 101.

The plurality of lateral faces 115 form the edges of the disk structure of the blade 111 that interconnect the working surface 113 and the handle 112 surface 114. The plurality of lateral faces 115 further comprises a first edge 191, a second edge 192, a third edge 193, and a fourth edge 194.

The edge guard 102 is a guard. The edge guard 102 attaches to the trowel 101 while the trowel 101 is stored. The edge guard 102 encloses the plurality of lateral faces 115 of the blade 111 such that the plurality of lateral faces 115 will not cause inadvertent damage. The edge guard 102 is an openwork structure. The edge guard 102 is geometrically similar to the blade 111. The perimeter of the edge guard 102 is greater than the perimeter of the blade 111 such that the blade 111 will insert into the edge guard 102 for storage. The edge guard 102 comprises a plurality of edge protectors 121, a plurality of gusset structures 122, a hinge 123, and a locking tab 124.

Each of the plurality of edge protectors 121 is in irregular prism structure. The congruent faces of the irregular prism structure has a hyoid shape. Each of the plurality of edge protectors 121 encloses an edge selected from the plurality of lateral faces 115 while the trowel 101 is in storage. The plurality of edge protectors 121 form the perimeter of the open work structure of the edge guard 102. The plurality of edge protectors 121 comprises a first hyoid prism structure 131, a second hyoid prism structure 132, a third hyoid prism structure 133, and a fourth hyoid prism structure 134.

The first hyoid prism structure 131 is a rectilinear structure. The congruent ends of the first hyoid prism structure 131 form a rectilinear hyoid shape. The interior edges of the hyoid structure that forms the first hyoid prism structure 131 forms a first groove 161 that runs through the interior of the first hyoid prism structure 131 in a direction parallel to the center axis of the first hyoid prism structure 131. The first groove 161 is sized to receive the blade 111.

The second hyoid prism structure 132 is a rectilinear structure. The congruent ends of the second hyoid prism structure 132 form a rectilinear hyoid shape. The interior edges of the hyoid structure that forms the second hyoid prism structure 132 forms a second groove 162 that runs through the interior of the second hyoid prism structure 132 in a direction parallel to the center axis of the second hyoid prism structure 132. The second groove 162 is sized to receive the blade 111.

The third hyoid prism structure 133 is a rectilinear structure. The congruent ends of the third hyoid prism structure 133 form a rectilinear hyoid shape. The interior edges of the hyoid structure that forms the third hyoid prism structure 133 forms a third groove 163 that runs through the interior of the third hyoid prism structure 133 in a direction parallel to the center axis of the third hyoid prism structure 133. The third groove 163 is sized to receive the blade 111.

The fourth hyoid prism structure 134 is a rectilinear structure. The congruent ends of the fourth hyoid prism structure 134 form a rectilinear hyoid shape. The interior edges of the hyoid structure that forms the fourth hyoid prism structure 134 forms a fourth groove 164 that runs through the interior of the fourth hyoid prism structure 134 in a direction parallel to the center axis of the fourth hyoid prism structure 134. The fourth groove 164 is sized to receive the blade 111.

The first groove 161, the second groove 162, the third groove 163, and the fourth groove 164 are aligned such that the plurality of lateral faces 115 of the blade 111 will simultaneously slide into and through the first groove 161, the second groove 162, the third groove 163, and the fourth groove 164.

The first edge 191 is the edge of the blade 111 that is stored with the first groove 161 of the first hyoid prism structure 131. The second edge 192 is the edge of the blade 111 that is stored with the second groove 162 of the second hyoid prism structure 132. The third edge 193 is the edge of the blade 111 that is stored with the third groove 163 of the third hyoid prism structure 133. The fourth edge 194 is the edge of the blade 111 that is stored with the fourth groove 164 of the fourth hyoid prism structure 134.

The plurality of gusset structures 122 is a mechanical structure. Each of the plurality of gusset structures 122 braces a joint formed between two adjacent edge protectors selected from the plurality of edge protectors 121. The plurality of gusset structures 122 comprises a first gusset structure 141, a second gusset structure 142, a third gusset structure 143, and a fourth gusset structure 144.

The first gusset structure 141 is a triangular structure that braces the joint formed by the fourth hyoid prism structure 134 and the first hyoid prism structure 131. The first gusset structure 141 attaches the fourth hyoid prism structure 134 to the first hyoid prism structure 131 such that the center axes of the fourth hyoid prism structure 134 and the first hyoid prism structure 131 are perpendicular to each other. The first gusset structure 141 attaches the fourth hyoid prism structure 134 to the first hyoid prism structure 131 such that the center axis of the groove formed by the fourth groove 164 perpendicularly intersects with the center axis of the first groove 161. The first gusset structure 141 further comprises a first superior gusset plate 171 and a first inferior gusset plate 181.

The second gusset structure 142 is a triangular structure that braces the joint formed by the first hyoid prism structure 131 and the second hyoid prism structure 132. The second gusset structure 142 attaches the first hyoid prism structure 131 to the second hyoid prism structure 132 such that the center axes of the first hyoid prism structure 131 and the second hyoid prism structure 132 are perpendicular to each other. The second gusset structure 142 attaches the first hyoid prism structure 131 to the second hyoid prism structure 132 such that the center axis of the groove formed by the first groove 161 perpendicularly intersects with the center axis of the second groove 162. The second gusset structure 142 further comprises a second superior gusset plate 172 and a second inferior gusset plate 182.

The third gusset structure 143 is a triangular structure that braces the joint formed by the second hyoid prism structure 132 and the third hyoid prism structure 133. The third gusset structure 143 attaches the second hyoid prism structure 132 to the third hyoid prism structure 133 such that the center axes of the second hyoid prism structure 132 and the third hyoid prism structure 133 are perpendicular to each other. The third gusset structure 143 attaches the second hyoid prism structure 132 to the third hyoid prism structure 133 such that the center axis of the groove formed by the second groove 162 perpendicularly intersects with the center axis of the third groove 163. The third gusset structure 143 further comprises a third superior gusset plate 173 and a third inferior gusset plate 183.

The fourth gusset structure 144 is a triangular structure that braces the joint formed by the third hyoid prism structure 133 and the fourth hyoid prism structure 134. The fourth gusset structure 144 attaches the third hyoid prism structure 133 to the fourth hyoid prism structure 134 such that the center axes of the third hyoid prism structure 133 and the fourth hyoid prism structure 134 are perpendicular to each other. The fourth gusset structure 144 attaches the third hyoid prism structure 133 to the fourth hyoid prism structure 134 such that the center axis of the groove formed by the third groove 163 perpendicularly intersects with the center axis of the fourth groove 164. The fourth gusset structure 144 further comprises a fourth superior gusset plate 174 and a fourth inferior gusset plate 184.

The hinge 123 is a mechanical structure. The hinge 123 attaches two adjacent edge protectors selected from the plurality of edge protectors 121 such that a first of the two adjacent edge protectors rotates relative to the second of the adjacent edge protectors.

The locking tab 124 is a fastening device. The locking tab 124 attaches the rotating adjacent edge protector attached to the hinge 123 to another adjacent edge protector selected from the plurality of edge protectors 121. The locking tab 124 locks the rotating edge protector into a fixed position. The locking tab 124 comprises a cantilever plate 151, a cantilever hook 152, a latch plate 153, and a latch hole 154.

The cantilever plate 151 is a rectangular disk-shaped structure. The cantilever plate 151 attaches the cantilever hook 152 to the third hyoid prism structure 133 to form the first element of the locking tab 124. The cantilever hook 152 is a hook structure that attaches to the cantilever plate 151 in the manner of a cantilever. The cantilever hook 152 inserts through the latch hole 154 to secure the second hyoid prism structure 132 to the third hyoid prism structure 133.

The latch plate 153 is a rectangular disk shapes structure. The latch plate 153 attaches the latch hole 154 to the second hyoid prism structure 132 to form the first element of the locking tab 124. The latch hole 154 is an aperture formed through the latch plate 153 that is sized and positioned to receive and secure the cantilever hook 152 such that the cantilever plate 151 is secured to the latch plate 153. The cantilever hook 152 bends perpendicularly to the center axis as it inserts through the latch hole 154 to secure the second hyoid prism structure 132 to the third hyoid prism structure 133.

The first superior gusset plate 171 is a triangular disk-shaped structure that attaches fourth hyoid prism structure 134 to the first hyoid prism structure 131 such that the first superior gusset plate 171 is proximal to and parallel to the handle 112 surface 114 of the blade 111. The first superior gusset plate 171 braces the fourth hyoid prism structure 134 to the first hyoid prism structure 131. The first inferior gusset plate 181 is a triangular disk-shaped structure that attaches fourth hyoid prism structure 134 to the first hyoid prism structure 131 such that the first inferior gusset plate 181 is proximal to and parallel to the working surface 113 of the blade 111. The first inferior gusset plate 181 braces the fourth hyoid prism structure 134 to the first hyoid prism structure 131.

The second superior gusset plate 172 is a triangular disk-shaped structure that attaches first hyoid prism structure 131 to the second hyoid prism structure 132 such that the second superior gusset plate 172 is proximal to and parallel to the handle 112 surface 114 of the blade 111. The second superior gusset plate 172 braces the first hyoid prism structure 131 to the second hyoid prism structure 132. The hinge 123 attaches the first hyoid prism structure 131 to the second hyoid prism structure 132 such that the second hyoid prism structure 132 rotates relative to the first hyoid prism structure 131. The second inferior gusset plate 182 is a triangular disk-shaped structure that attaches first hyoid prism structure 131 to the second hyoid prism structure 132 such that the second inferior gusset plate 182 is proximal to and parallel to the working surface 113 of the blade 111. The second inferior gusset plate 182 braces the first hyoid prism structure 131 to the second hyoid prism structure 132.

The third superior gusset plate 173 is a triangular disk-shaped structure that attaches second hyoid prism structure 132 to the third hyoid prism structure 133 such that the third superior gusset plate 173 is proximal to and parallel to the handle 112 surface 114 of the blade 111. The third superior gusset plate 173 braces the second hyoid prism structure 132 to the third hyoid prism structure 133. The third inferior gusset plate 183 is a triangular disk-shaped structure that attaches second hyoid prism structure 132 to the third hyoid prism structure 133 such that the third inferior gusset plate 183 is proximal to and parallel to the working surface 113 of the blade 111. The third inferior gusset plate 183 braces the second hyoid prism structure 132 to the third hyoid prism structure 133.

The fourth superior gusset plate 174 is a triangular disk-shaped structure that attaches third hyoid prism structure 133 to the fourth hyoid prism structure 134 such that the fourth superior gusset plate 174 is proximal to and parallel to the handle 112 surface 114 of the blade 111. The fourth superior gusset plate 174 braces the third hyoid prism structure 133 to the fourth hyoid prism structure 134. The fourth inferior gusset plate 184 is a triangular disk-shaped structure that attaches third hyoid prism structure 133 to the fourth hyoid prism structure 134 such that the fourth inferior gusset plate 184 is proximal to and parallel to the working surface 113 of the blade 111. The fourth inferior gusset plate 184 braces the third hyoid prism structure 133 to the fourth hyoid prism structure 134.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Blade: As used in this disclosure, a blade is a term that is used to describe: 1) a wide and flat portion of a structure; or, 2) the cutting edge of a tool.

Brace: As used in this disclosure, a brace is a structural element that is used to support, stabilize, or otherwise steady an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk.

In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Fastener: As used in this disclosure, a fastener is a device that is used to removably attach a first object to a second object.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Groove: As used in this disclosure, a groove is an open channel or trough used to guide the motion of an object.

Guard: As used in this disclosure, a guard is an inert structure that attaches to a tool such that the guard forms a barrier intended to prevent the tool from causing injury or harm.

Gusset: As used in this disclosure, a gusset is an angled structural member used to stabilize a section of a framework. By angled is meant that the gusset is neither parallel nor perpendicular to the structures being stabilized.

Hand Tool: As used in this disclosure, a hand tool refers to a tool that is small and light enough to allow a person to hold the tool during use.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of length of the first arm roughly equals the span of the length of the second arm. Hyoids generally have a U shaped appearance.

Latch: As used in this disclosure, a latch is a fastening or locking mechanism. The use of the term latch does not necessarily but often implies the insertion of an object into a notch or cavity.

Locking Tab: As used in this disclosure, a locking tab is a two element fastener wherein the first element of the fastener, which is mounted on a first object is a cantilever spring and the second element of the fastener is a hole which is formed in a second object. The free end of the cantilever spring has a hook formed in it such that when the free end of the cantilever spring is inserted into the hole, the hook latches against the edge of the hole preventing inadvertent removal of the cantilever spring. The first element is removed from the second element by bending the cantilever spring such that the hook clears the edge of the hole and then pulling the first element away from the second element.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Relaxed Shape: As used in this disclosure, a structure is considered to be in its relaxed state when no shear, strain, or torsional forces are being applied to the structure.

Slot: As used in this disclosure, a slot is a long narrow groove or aperture that is formed in an object.

Tool: As used in this disclosure, a tool is a device, an apparatus, or an instrument that is used to carry out an activity, operation, or procedure.

Trowel: As used in this disclosure, a trowel is a bladed hand tool used to apply a layer of a viscous material to a surface.

Viscosity: As used in this disclosure, viscosity refers to the resistance of a liquid or an elastic material to deformation. Higher viscosity would refer to a greater resistance to flow and to deformation.

Viscous: As used in this disclosure, a viscous material is a material with a viscosity such that the viscous material has characteristics intermediate between a liquid and a solid.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A trowel protector accessory comprising: a trowel and an edge guard; wherein the edge guard encloses a plurality of lateral faces of the trowel when the trowel is stored; wherein the trowel protector accessory encloses the plurality of lateral faces of the trowel; wherein the trowel protector accessory prevents the edges of the trowel from causing inadvertent damage; wherein the edge guard comprises a plurality of edge protectors, a plurality of gusset structures, a hinge, and a locking tab; wherein the plurality of gusset structures, the hinge, and the locking tab attach to the plurality of edge protectors; wherein the hinge is a mechanical structure; wherein the hinge attaches two adjacent edge protectors selected from the plurality of edge protectors such that a first of the two adjacent edge protectors rotates relative to a second of the adjacent edge protectors; wherein the locking tab is a fastening device; wherein the locking tab attaches the rotating adjacent edge protector attached to the hinge to another adjacent edge protector selected from the plurality of edge protectors; wherein the locking tab locks the rotating edge protector into a fixed position; wherein the locking tab comprises a cantilever plate, a cantilever hook, a latch plate, and a latch hole.

2. The trowel protector accessory according to claim 1
wherein the trowel is a hand tool;
wherein the trowel is a bladed tool.

3. The trowel protector accessory according to claim 2
wherein the edge guard is a guard;
wherein the edge guard attaches to the trowel;
wherein the edge guard is an openwork structure.

4. The trowel protector accessory according to claim 3
wherein the trowel comprises a blade and a handle;
wherein the blade is a disk-shaped structure that is further defined with a working surface, a handle surface, and a plurality of lateral faces.

5. The trowel protector accessory according to claim 4
wherein the blade is a disk-shaped structure;
wherein the blade forms the working element of the trowel;
wherein the blade is the element of the trowel that is stored in the edge guard;
wherein the handle is a grip;
wherein the handle attaches to the blade;
wherein the plurality of lateral faces form the edges of the disk structure of the blade that interconnect the working surface and the handle surface.

6. The trowel protector accessory according to claim 5
wherein the edge guard encloses the plurality of lateral faces of the blade;
wherein the edge guard is geometrically similar to the blade;
wherein the perimeter of the edge guard is greater than the perimeter of the blade such that the blade will insert into the edge guard for storage.

7. The trowel protector accessory according to claim 6
wherein each of the plurality of edge protectors is in irregular prism structure;
wherein the congruent faces of the irregular prism structure has a hyoid shape;
wherein each of the plurality of edge protectors encloses an edge selected from the plurality of lateral faces while the trowel is in storage.

8. The trowel protector accessory according to claim 7 wherein the plurality of edge protectors form the perimeter of the open work structure of the edge guard.

9. The trowel protector accessory according to claim 8
wherein the plurality of gusset structures is a mechanical structure;
wherein each of the plurality of gusset structures braces a joint formed between two adjacent edge protectors selected from the plurality of edge protectors.

10. The trowel protector accessory according to claim 9
wherein the cantilever plate is a rectangular disk-shaped structure;
wherein the cantilever plate attaches the cantilever hook to the third hyoid prism structure to form a first element of the locking tab;
wherein the cantilever hook is a hook structure that attaches to the cantilever plate in the manner of a cantilever;
wherein the cantilever hook inserts through the latch hole to secure the second hyoid prism structure to the third hyoid prism structure;
wherein the latch plate is a rectangular disk shapes structure;
wherein the latch plate attaches the latch hole to the second hyoid prism structure to form the first element of the locking tab;
wherein the latch hole is an aperture formed through the latch plate that is sized and positioned to receive and secure the cantilever hook such that the cantilever plate is secured to the latch plate;

wherein the cantilever hook bends perpendicularly to the center axis as it inserts through the latch hole to secure the second hyoid prism structure to the third hyoid prism structure.

11. The trowel protector accessory according to claim 10 wherein the plurality of edge protectors comprises a first hyoid prism structure, a second hyoid prism structure, a third hyoid prism structure, and a fourth hyoid prism structure;

wherein the first hyoid prism structure is a rectilinear structure;

wherein the second hyoid prism structure is a rectilinear structure;

wherein the third hyoid prism structure is a rectilinear structure;

wherein the fourth hyoid prism structure is a rectilinear structure;

wherein the congruent ends of the first hyoid prism structure form a rectilinear hyoid shape;

wherein the congruent ends of the second hyoid prism structure form a rectilinear hyoid shape;

wherein the congruent ends of the third hyoid prism structure form a rectilinear hyoid shape;

wherein the congruent ends of the fourth hyoid prism structure form a rectilinear hyoid shape.

12. The trowel protector accessory according to claim 11 wherein the interior edges of the hyoid structure that forms the first hyoid prism structure forms a first groove that runs through the interior of the first hyoid prism structure in a direction parallel to the center axis of the first hyoid prism structure;

wherein the interior edges of the hyoid structure that forms the second hyoid prism structure forms a second groove that runs through the interior of the second hyoid prism structure in a direction parallel to the center axis of the second hyoid prism structure;

wherein the interior edges of the hyoid structure that forms the third hyoid prism structure forms a third groove that runs through the interior of the third hyoid prism structure in a direction parallel to the center axis of the third hyoid prism structure;

wherein the interior edges of the hyoid structure that forms the fourth hyoid prism structure forms a fourth groove that runs through the interior of the fourth hyoid prism structure in a direction parallel to the center axis of the fourth hyoid prism structure;

wherein the first groove is sized to receive the blade;

wherein the second groove is sized to receive the blade;

wherein the third groove is sized to receive the blade;

wherein the fourth groove is sized to receive the blade.

13. The trowel protector accessory according to claim 12 wherein the plurality of lateral faces further comprises a first edge, a second edge, a third edge, and a fourth edge;

wherein the first groove, the second groove, the third groove, and the fourth groove are aligned such that the plurality of lateral faces of the blade will simultaneously slide into and through the first groove, the second groove, the third groove, and the fourth groove;

wherein the first edge is the edge of the blade that is stored with the first groove of the first hyoid prism structure;

wherein the second edge is the edge of the blade that is stored with the second groove of the second hyoid prism structure;

wherein the third edge is the edge of the blade that is stored with the third groove of the third hyoid prism structure;

wherein the fourth edge is the edge of the blade that is stored with the fourth groove of the fourth hyoid prism structure.

14. The trowel protector accessory according to claim 13 wherein the plurality of gusset structures comprises a first gusset structure, a second gusset structure, a third gusset structure, and a fourth gusset structure;

wherein the first gusset structure is a triangular structure that braces the joint formed by the fourth hyoid prism structure and the first hyoid prism structure;

wherein the second gusset structure is a triangular structure that braces the joint formed by the first hyoid prism structure and the second hyoid prism structure;

wherein the third gusset structure is a triangular structure that braces the joint formed by the second hyoid prism structure and the third hyoid prism structure;

wherein the fourth gusset structure is a triangular structure that braces the joint formed by the third hyoid prism structure and the fourth hyoid prism structure.

15. The trowel protector accessory according to claim 14 wherein the first gusset structure attaches the fourth hyoid prism structure to the first hyoid prism structure such that the center axes of the fourth hyoid prism structure and the first hyoid prism structure are perpendicular to each other;

wherein the second gusset structure attaches the first hyoid prism structure to the second hyoid prism structure such that the center axes of the first hyoid prism structure and the second hyoid prism structure are perpendicular to each other;

wherein the third gusset structure attaches the second hyoid prism structure to the third hyoid prism structure such that the center axes of the second hyoid prism structure and the third hyoid prism structure are perpendicular to each other;

wherein the fourth gusset structure attaches the third hyoid prism structure to the fourth hyoid prism structure such that the center axes of the third hyoid prism structure and the fourth hyoid prism structure are perpendicular to each other.

16. The trowel protector accessory according to claim 15 wherein the first gusset structure attaches the fourth hyoid prism structure to the first hyoid prism structure such that the center axis of the groove formed by the fourth groove perpendicularly intersects with the center axis of the first groove;

wherein the second gusset structure attaches the first hyoid prism structure to the second hyoid prism structure such that the center axis of the groove formed by the first groove perpendicularly intersects with the center axis of the second groove;

wherein the third gusset structure attaches the second hyoid prism structure to the third hyoid prism structure such that the center axis of the groove formed by the second groove perpendicularly intersects with the center axis of the third groove;

wherein the fourth gusset structure attaches the third hyoid prism structure to the fourth hyoid prism structure such that the center axis of the groove formed by the third groove perpendicularly intersects with the center axis of the fourth groove.

17. The trowel protector accessory according to claim 16 wherein the first gusset structure further comprises a first superior gusset plate and a first inferior gusset plate;

wherein the second gusset structure further comprises a second superior gusset plate and a second inferior gusset plate;

wherein the third gusset structure further comprises a third superior gusset plate and a third inferior gusset plate;

wherein the fourth gusset structure further comprises a fourth superior gusset plate and a fourth inferior gusset plate;

wherein the first superior gusset plate is a triangular disk-shaped structure that attaches fourth hyoid prism structure to the first hyoid prism structure such that the first superior gusset plate is proximal to and parallel to the handle surface of the blade;

wherein the first superior gusset plate braces the fourth hyoid prism structure to the first hyoid prism structure;

wherein the first inferior gusset plate is a triangular disk-shaped structure that attaches fourth hyoid prism structure to the first hyoid prism structure such that the first inferior gusset plate is proximal to and parallel to the working surface of the blade;

wherein the first inferior gusset plate braces the fourth hyoid prism structure to the first hyoid prism structure;

wherein the second superior gusset plate is a triangular disk-shaped structure that attaches first hyoid prism structure to the second hyoid prism structure such that the second superior gusset plate is proximal to and parallel to the handle surface of the blade;

wherein the second superior gusset plate braces the first hyoid prism structure to the second hyoid prism structure;

wherein the second inferior gusset plate is a triangular disk-shaped structure that attaches first hyoid prism structure to the second hyoid prism structure such that the second inferior gusset plate is proximal to and parallel to the working surface of the blade;

wherein the second inferior gusset plate braces the first hyoid prism structure to the second hyoid prism structure;

wherein the third superior gusset plate is a triangular disk-shaped structure that attaches second hyoid prism structure to the third hyoid prism structure such that the third superior gusset plate is proximal to and parallel to the handle surface of the blade;

wherein the third superior gusset plate braces the second hyoid prism structure to the third hyoid prism structure;

wherein the third inferior gusset plate is a triangular disk-shaped structure that attaches second hyoid prism structure to the third hyoid prism structure such that the third inferior gusset plate is proximal to and parallel to the working surface of the blade;

wherein the third inferior gusset plate braces the second hyoid prism structure to the third hyoid prism structure;

wherein the fourth superior gusset plate is a triangular disk-shaped structure that attaches third hyoid prism structure to the fourth hyoid prism structure such that the fourth superior gusset plate is proximal to and parallel to the handle surface of the blade;

wherein the fourth superior gusset plate braces the third hyoid prism structure to the fourth hyoid prism structure;

wherein the fourth inferior gusset plate is a triangular disk-shaped structure that attaches third hyoid prism structure to the fourth hyoid prism structure such that the fourth inferior gusset plate is proximal to and parallel to the working surface of the blade;

wherein the fourth inferior gusset plate braces the third hyoid prism structure to the fourth hyoid prism structure.

18. The trowel protector accessory according to claim 17 wherein the hinge attaches the first hyoid prism structure to the second hyoid prism structure such that the second hyoid prism structure rotates relative to the first hyoid prism structure.

* * * * *